US006089124A

United States Patent [19]

Murphy

[11] Patent Number: 6,089,124

[45] Date of Patent: Jul. 18, 2000

[54] ELECTRIC BOTTLE OPENER

[76] Inventor: Gary Murphy, 4621 Hamlin, Corpus Christi, Tex. 78411

[21] Appl. No.: 09/065,929

[22] Filed: Apr. 24, 1998

[51] Int. Cl.[7] ..... B67B 7/00

[52] U.S. Cl. ..... 81/3.39; 81/3.2; 81/3.4

[58] Field of Search ..... 81/3.2, 3.39, 3.36, 81/3.4, 3.07

[56] References Cited

U.S. PATENT DOCUMENTS

| | | | |
|---|---|---|---|
| D. 303,343 | 9/1989 | Nuss . | |
| 3,812,742 | 5/1974 | Polasek . | |
| 3,950,801 | 4/1976 | Morrison . | |
| 4,762,029 | 8/1988 | Chen | 81/3.2 |
| 5,003,844 | 4/1991 | Barrow . | |
| 5,167,172 | 12/1992 | Heebner | 81/3.2 |
| 5,271,296 | 12/1993 | Parent et al. . | |
| 5,329,831 | 7/1994 | Pierce, Jr. et al. | 81/3.2 |
| 5,345,844 | 9/1994 | Marsaw . | |
| 5,370,019 | 12/1994 | Sartell et al. . | |
| 5,430,923 | 7/1995 | Parent et al. | 81/3.2 |
| 5,647,251 | 7/1997 | Hardman | 81/3.2 |

FOREIGN PATENT DOCUMENTS 2254791 5/1974 Germany .

*Primary Examiner*—David A. Scherbel
*Assistant Examiner*—Joni B. Danganan
*Attorney, Agent, or Firm*—Richard C. Litman

[57] ABSTRACT

An electric bottle or jar lid opener which loosens threaded lids from jars or similar containers having screw-type lids. A base member supports a vertical support which supports a travel arm, which in turn supports an electric motor. The motor 38 is positioned over the base such that a bottle may be manually positioned below the motor, which is provided with a direct drive mechanism which transfers torque through a shaft to a gripping member affixed thereon. The gripping member, made of a non-slip material, such as rubber, is placed onto the lid of a bottle. The travel arm has height adjustment knobs allowing the user to position the opener on various sized bottles. The motor is controlled by a variable power button which torques the gripping member in turn loosening the lid.

19 Claims, 4 Drawing Sheets

ELECTRIC BOTTLE OPENER

BACKGROUND OF THE INVENTION

1. Field of the Invention

The present invention relates generally to lid openers. More specifically, the invention relates to an electric bottle or jar lid opener.

2. Description of the Prior Art

Electrically motorized container openers, particularly can openers, are well known in the art and for many years have been a great asset to many users. For example, the electric can openers are both faster and easier to use than manual can openers. This allows those who are either disabled or lack the manual dexterity to open cans that would have otherwise been extremely hard or impossible for them to open.

As with such can openers, there is a need for electric bottle or jar openers. In many instances, jars or bottles are so tightly closed or sealed that they become unduly difficult to open. An easy to use and easily adjustable electric bottle opener would benefit young and old alike. Again, as with can openers, those who are disabled or lack strength or manual dexterity often find it difficult to loosen tightly closed jars or bottles. Even those who possess great strength and dexterity, such as those who work as food caterers or in restaurants and must open many jars per day, will find it convenient to have an electric bottle or jar opener. A portable electric jar opener allows users to use the openers at the counters where they are preparing food. This adds greatly to the practicality and usefulness of electric can openers for both the housewife and professional food preparer.

There is, therefore, a need for a portable electric bottle opener that is easily adjustable for different bottle heights, has an easily removable motor with a variable power control and is easy to use and store. The present invention provides such a device.

Electric bottle openers have been described in the patent literature. For instance, U.S. Pat. No. 5,271,296 issued to Parent et al. on Dec. 21, 1993, U.S. Pat. No. 5,370,019 issued to Sartell et al. on Dec. 6, 1994 and U.S. Pat. No. 3,950,801 issued to Morrison on Apr. 20, 1976 describe electric bottle openers wherein the motor is positioned within the base member rather than in the travel arm as a direct drive proximate the cap removal portion.

U.S. Pat. No. 5,003,844 issued to Barrow on Apr. 2, 1991, and U.S. Pat. No. 3,812,742 issued to Polasek on May 28, 1974 describe electric bottle openers but do not disclose removable motors located within a removable travel arm.

U.S. Pat. No. 5,345,844 issued to Marsaw on Sep. 13, 1994, and U.S. Pat. No. Des. 303,343 issued to Nuss on Sep. 12, 1989 along with German Pat. No. 2,254,791 describe electric bottle openers, but fail to disclose removable motors within a travel arm.

None of the above inventions and patents, taken either singly or in combination, is seen to describe the instant invention as claimed.

SUMMARY OF THE INVENTION

The present invention is directed to a portable electric bottle opener. The opener of the instant invention has advantages over the conventional electric bottle openers in that the travel arm is easily removable from the vertical support which facilitates the replacement, cleaning or storage of the opener in general and the individual parts in particular. On the sides of the travel arm are adjustment knobs which turn gears within the travel arm that mesh with the track on the vertical support. The turning of the gears causes the travel arm to move up or down depending on the rotation of the knob.

A variable-speed power button in the travel arm controls the amount of torque the motor places on the bottle. The motor can easily be removed from the travel arm which greatly assists in repair or ease of replacement. The travel arm is secured to the vertical support via a dovetail connection that ensures a strong connection that will not fail when the device is in operation.

Power is supplied by an electrical cord that exits the base and connects, via internal wiring circuits, the motor to an electrical power source. An on-off switch connects motor to the power source through the variable-speed power button. The present invention has a two-level safety feature, namely, for the motor to operate both the on-off switch must be in the "on" position and the user must depress the variable power button. This depresser feature protects against accidental operation of the device. Moreover, in accordance with the intended object of an easily disassemblable device, the rubber holder attached to the motor is easily removable from the motor and the vertical support is easily removable from the base.

Accordingly, it is a principal object of the invention to provide a portable electric bottle opener.

It is another object of the invention to provide an electric bottle opener wherein the travel arm is removably and adjustably connected to a vertical support to permit vertical adjustment for receiving containers of various heights.

It is a further object of the invention to provide an electric bottle opener having a motor connected to the travel arm proximate a bottle to be opened so as to provide a direct torque drive.

Still another object of the invention is to provide an electric bottle opener wherein the motor is easily removable for cleaning of the invention.

An additional object of the invention is to provide an electric bottle opener having a variable-speed power control to supply additional torque to tightly sealed container tops.

It is another object of the invention to provide an electric bottle opener having a safety feature requiring operation of both an on-off switch and a intermittent switch to supply power to the motor.

Yet another object of the invention is to provide an electric bottle opener having a worm gear in mesh with a track located within the vertical support to prevent slippage.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
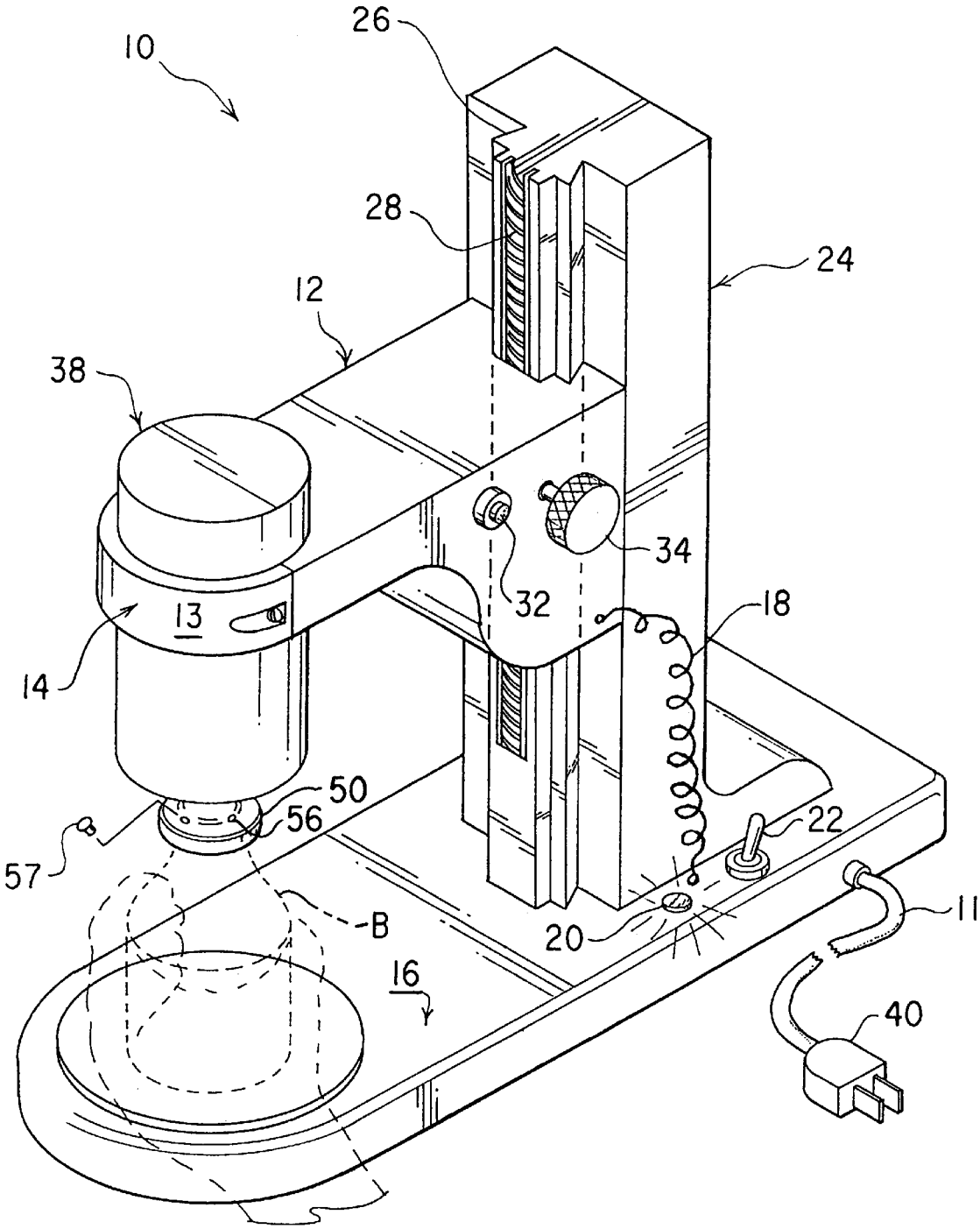
FIG. 1 is perspective view of the present invention.
Figure 2:
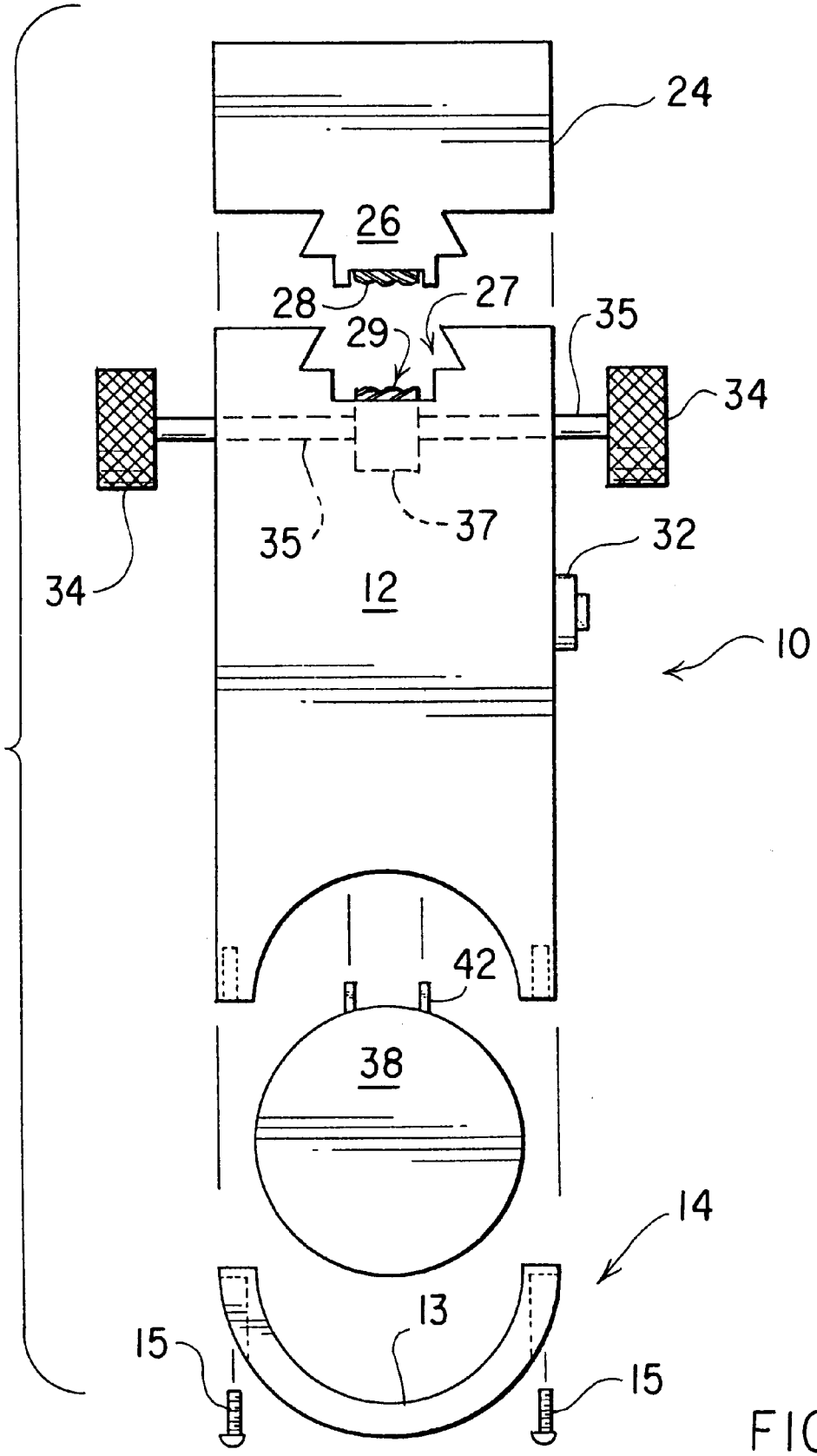
FIG. 2 is an exploded top plan view of the present invention.

Turning now to FIG. 1 and FIG. 2 of the drawings, the electric bottle opener 10 is shown as an assembly of several easily removable component parts, namely, a base member 16 attached to a vertical support 24 which supports a travel arm 12, which in turn supports an electric motor 38. As can be seen from FIG. 1, the motor 38 is positioned over the base 16 by means of the travel arm 12 such that a bottle B, having a threaded generally circular closure, or screw-type lid, may be manually positioned upon the base 16 and below the motor 38. The motor 38 is provided with a direct drive mechanism which transfers torque through a shaft to a rubber gripping member 50 affixed thereon and placed onto the lid of a bottle B.

In order to vary the height of the motor 38 with respect to the vertical support 24, the travel arm 12 is slidably attached to the vertical support 24 by a dovetail 26 defined by the vertical support 24. The dovetail 26 matingly engages a dovetail channel 27 defined in the travel arm 12. A threaded track 28 of a worm drive type (having angled engaging threads), extending substantially the length of the vertical support 24, is attached to the dovetail 26. A corresponding worm gear wheel 29 is positioned within the dovetail channel 27 and partially housed within the travel arm 12. This type of assembly is preferred, in that the track and gear wheel engage in a manner which limits undesired vertical movement which may otherwise be caused by the force of gravity acting on the travel arm.

To further prevent undesired movement, gear wheel 29 is spring biased towards track 28 by means 37 (represented by phantom lines) housed inside travel arm 12, and, is operably connected by a shaft 35 to an external and manually rotatable knob 34. Worm drive gear assemblies, both spring biased and otherwise, are well known by those skilled in such arts, from which a suitable gear assembly may be chosen so that by turning knob 34, it moves gear wheel 29 and therefore travel arm 12 up or down on the vertical support 24.

During assembly, the travel arm 12 is positioned within the dovetail channel 27 by placement onto the dovetail 26, and slid downward until gear wheel 29 engages track 28. Thus, when the dovetail 26 is inserted into the channel 27, the gear wheel 29 is forced into tight engagement with the track 28 by virtue of the biasing means 37. To adjust the travel arm 12 vertically along the track 28, the user turns the knob 34, either clockwise or counter-clockwise to raise or lower travel arm 12, the direction being solely dependent upon the type of track 28 used. Gear wheel 29 meshes with track 28 in a snug relationship wherein each turn of knob 34 forces gear wheel 29 to step up or down, which in turn moves travel arm 12 up or down. The dovetail connection ensures a strong and secure attachment during operation of electric bottle opener 10.

Motor 38 is removably connected to travel arm 12 by means of an end connector assembly 14. The assembly 14 employs screws 15 which pass through apertures and a recess (not numbered) defined by a clamp arm 13 dimensioned and configured to closely engage and encircle the motor 38, thereby mechanically and immovably securing the motor 38 in place against the travel arm 12.

The motor 38 is electrically connected by means of electric prongs 42 which engage standard electrical components of a wiring circuit which terminates with a standard household outlet plug 40 (joined to an electric power cord 11) for connection to a household electrical outlet. Beginning with the motor 38, the circuit includes a corresponding socket (not shown) receiving the prongs 42 of the motor 38, and wiring internally housed in the travel arm 12, which is electrically coupled with a variable-speed power button 32. The button 32 effectively represents and controls a dimmer switch which, when the button is pressed inward, supplies increasing power to the motor 38 with the increase of distance over which the button travels. Thus, the amount of torque that the motor 38 places on the cap of the bottle B is determined by how far towards the travel arm 12 that the variable power button 32 is pushed; the farther the variable power button 32 is pushed in, the greater the torque placed on the lid of the bottle B.

The circuit wiring exits the travel arm to electrically join a flexible and expansible coiled cord 18. The coiled cord 18 permits extension sufficient to allow the travel arm 12 to be maximally raised along the track 28. Alternative wiring arrangements may be used to permit up and down movement of the travel arm 12. The cord 18 in turn passes into the base 16, which houses the remainder of the circuit components, which include an on-off switch 22. A power indicator light 20 is positioned in series with the on-off switch 22 so that, when the switch 22 is placed in the "on" position, the indicator light 20 is illuminated. Moreover, in combination with the button 32, a safety feature against accidents arising from contact with the motor is achieved, whereby power is supplied to motor 38 only when the on-off switch 22 is in the "on" position and variable power button 32 is pressed.

Figure 4:
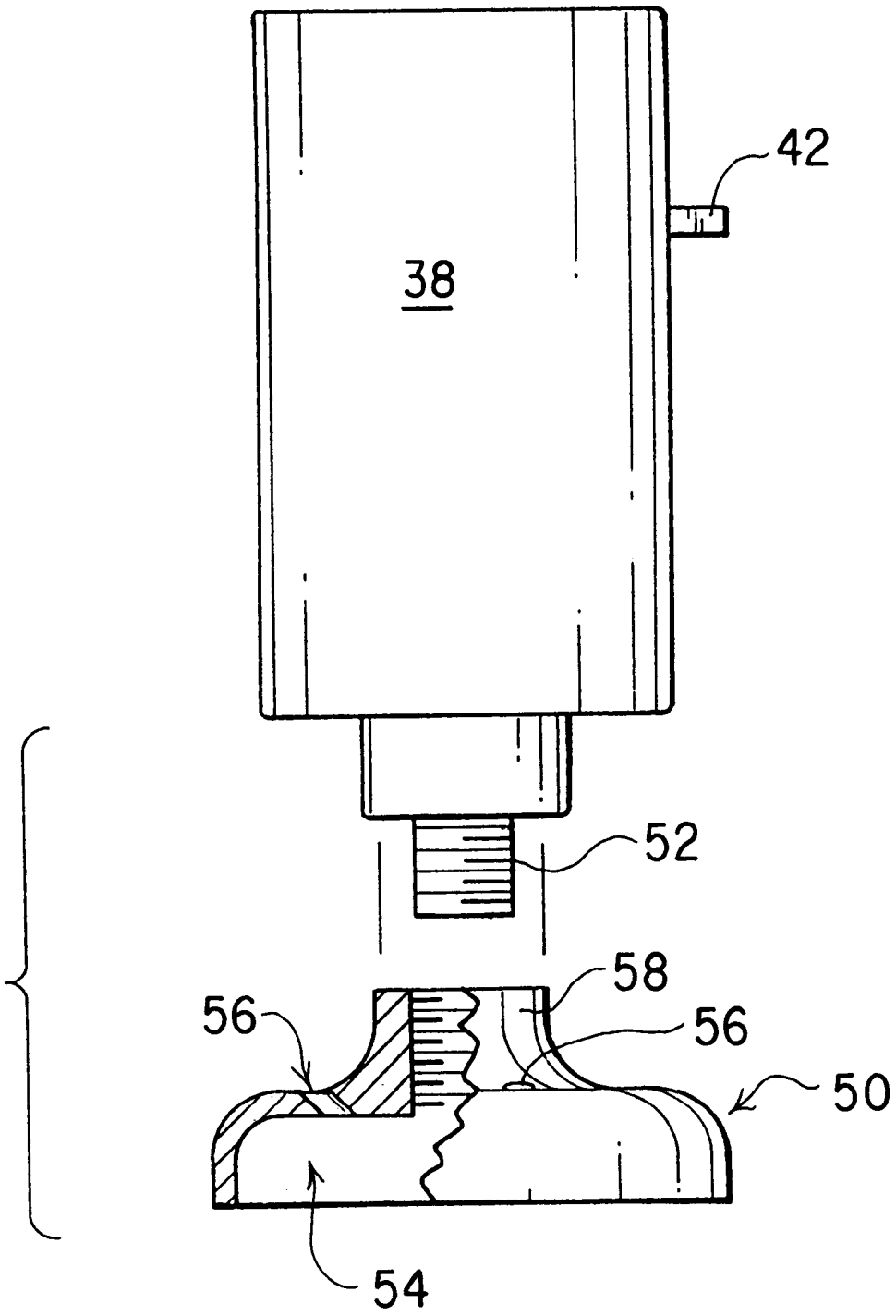
FIG. 4 is a partially sectioned, front elevational view of the motor and cap engaging component of the present invention.

To effectively transfer torque from the motor to the bottle cap, a non-slip gripping member 50 (best seen in FIG. 4) is attached to the motor 38, which includes a threaded shaft 52. The non-slip gripping member 50 is configured to have a shaft-receiving portion 58 and a concave portion 54 which is adapted to flexibly fit onto a cap or lid. The shaft-receiving portion 58 is matingly threaded to receive the threaded shaft 52 of the motor. The concave portion 54 is preferably made of rubber, which has the characteristics of being non-slip and able to be deformed when a solid object, such as a lid or cap, is pressed into it. Thus, when a user holds a jar or bottle and presses its lid or cap into the concave portion 54, the material frictionally grabs the lid or cap and transfers the torque supplied from the motor shaft 52 to the lid.

The concave portion 54 also defines small holes 56, through which an thin rod may be poked to free an obstructing lid caught within the concave portion 54. To occlude the holes 56, a plug 57 is provided for each, sized to removably fit into each hole, which aids in cleaning of the concave portion 54 by preventing undesired soiling within the holes 56 when not in use. The plugs may be made of the same resilient material as that used for the concave portion, such as rubber.

Figure 3:
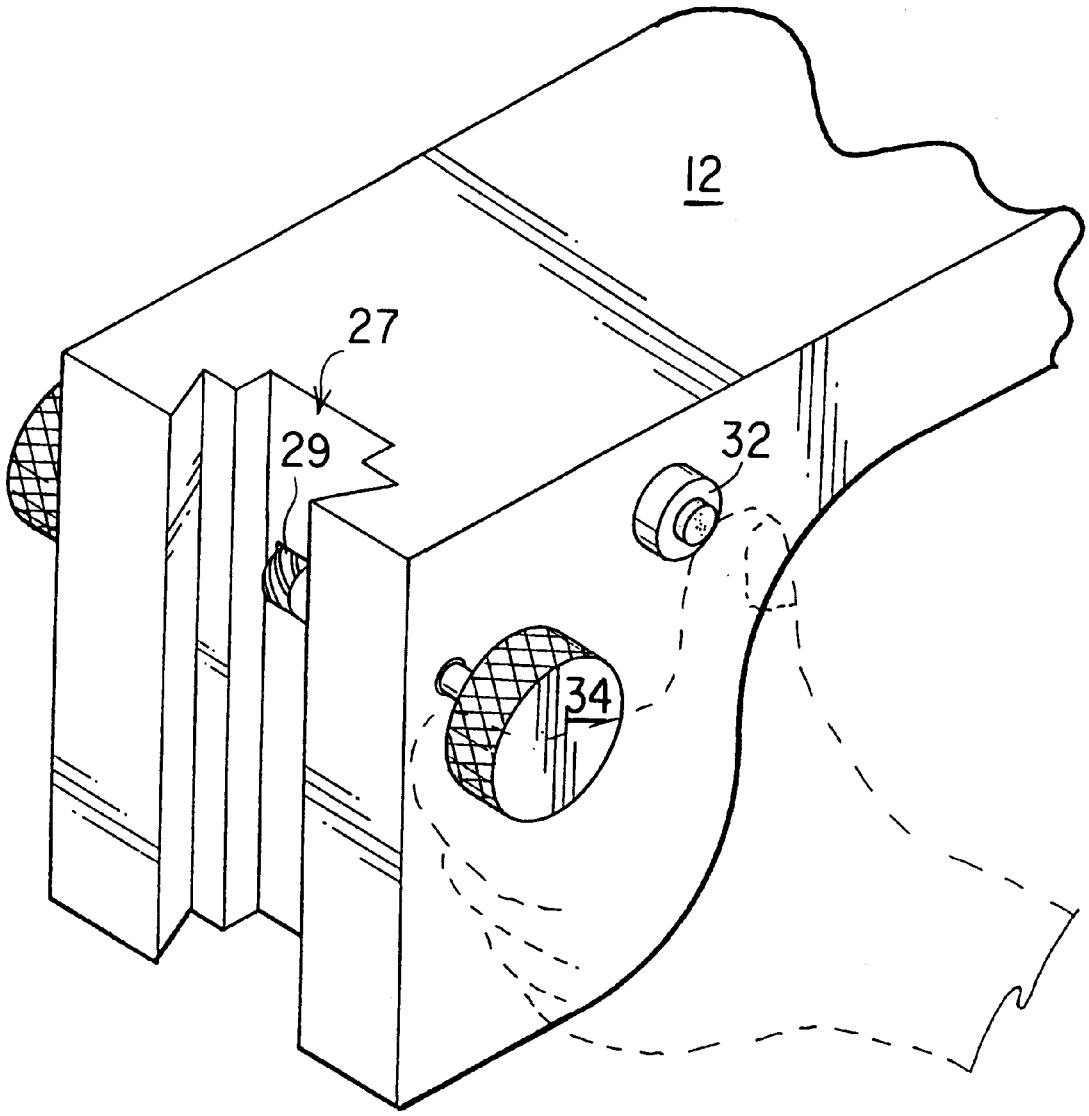
FIG. 3 is a partial perspective view of the travel arm.

Finally, the variable-speed power button 32 controlling the motor is positioned proximate the knob 34, to allow one-handed operation of the device 10 due to the necessity of holding the jar or bottle B in the other hand. As can be understood from FIG. 3 of the drawings, when the user desires to raise or lower travel arm 12 while supplying power to the motor, the knob 34 may be turned in either a clockwise or counter-clockwise direction which rotates gear wheel 29 against the track, to raise or lower the travel arm 12 in order to properly position the gripping member 50 on the lid or cap. When the desired height of the travel arm 12 is attained, the thumb of the hand operating the knob 34 may be extended to depress the button 32 to supply variable power to the motor until the lid is removed.

It is to be understood that the present invention is not limited to the sole embodiment described above, but encompasses any and all embodiments within the scope of the following claims.

What is claimed is:

1. An electric bottle opener comprising;

a base;

a vertical support extending upwardly from said base;

a travel arm slidably engaging said vertical support;

a gear wheel assembly having a gear wheel rotatably positioned on said travel arm and a track defined by said vertical support, said gear wheel engaging said track, and a manually operable knob controlling operation of said gear wheel;

an electric motor having a shaft, said motor for supplying torque through said shaft, said motor attached to said travel arm with said shaft oriented downward;

a gripping member for transferring torque to a generally circular closure member, said gripping member constructed of a material having a non-slip surface and resilient, shape-retaining memory, said gripping member attached to said shaft of said motor; and a circuit electrically coupled to said motor, having switching means for controlling the amount of torque supplied by said motor.

2. The adjustable bottle opener according to claim 1, further including spring-biasing means for biasing said gear against said track.

3. The adjustable bottle opener according to claim 1, wherein said switching means includes an on-off switch.

4. The adjustable bottle opener according to claim 3, wherein said circuit includes an indicator light coupled in series with said on-off switch.

5. The adjustable bottle opener according to claim 1, wherein said switching means includes a means for variably increasing electrical power to said motor for variably increasing torque.

6. The adjustable bottle opener according to claim 5, wherein said means is a depressible button coupled to a variable decreasingly-resistive switch for increasing power to said motor as said button is depressed.

7. The adjustable bottle opener according to claim 6, wherein said depressible button is positioned proximate said knob to allow one-handed operation of both the knob and said button.

8. The adjustable bottle opener according to claim 1, wherein said circuit includes a power cord and plug for coupling with a standard household electrical outlet.

9. The adjustable bottle opener according to claim 1, wherein said vertical support defines a dovetail and said travel arm defines a channel mating said dovetail, said travel arm removably attached to said vertical support by said dovetail engaging said channel.

10. The adjustable bottle opener according to claim 1, further including connection means for removably attaching said motor to said travel arm.

11. The adjustable bottle opener according to claim 10, wherein said connection means for removably attaching said motor to said travel arm include fastening means and a clamp arm dimensioned and configured to encircle said motor when joined to said travel arm with said fastening means.

12. The adjustable bottle opener according to claim 1, wherein said material of said gripping member is rubber.

13. The adjustable bottle opener according to claim 1, wherein said shaft and said gripping member include means for removably attaching one to the other.

14. The adjustable bottle opener according to claim 13, wherein said means are defined by said shaft being threaded, and said gripping member includes a shaft-receiving portion being matingly threaded.

15. The adjustable bottle opener according to claim 1, wherein said gripping member includes a concave portion for receiving the generally circular closure, said concave portion being made of said material having a non-slip surface and resilient, shape-retaining memory.

16. The adjustable bottle opener according to claim 15, wherein said concave portion defines a through aperture, whereby a rod may be passed through said concave portion to remove a generally circular closure lodged in said concave portion.

17. The adjustable bottle opener according to claim 16, further including a plug for removably placing into and residing within said through aperture.

18. The adjustable bottle opener according to claim 1, wherein said track and gear wheel are of the worm-drive type, whereby said track and gear wheel engage to limit undesired vertical movement.

19. The adjustable bottle opener according to claim 1, wherein said circuit includes a coiled extensible cord attached between said base and said travel arm.

* * * * *